US007882635B2

(12) United States Patent
Wakayama et al.

(10) Patent No.: US 7,882,635 B2
(45) Date of Patent: Feb. 8, 2011

(54) METHOD FOR PRODUCING INK-JET HEAD AND INK-JET HEAD

(75) Inventors: Hiroaki Wakayama, Ama-gun (JP); Kazuo Kobayashi, Kakamigahara (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 229 days.

(21) Appl. No.: 12/232,880

(22) Filed: Sep. 25, 2008

(65) Prior Publication Data

US 2009/0038152 A1 Feb. 12, 2009

Related U.S. Application Data

(62) Division of application No. 11/090,843, filed on Mar. 25, 2005, now abandoned.

(30) Foreign Application Priority Data

Mar. 31, 2004 (JP) ..... 2004-106538

(51) Int. Cl.
*B23P 17/00* (2006.01)
*B41J 2/045* (2006.01)

(52) U.S. Cl. ..... 29/890.1; 29/25.35; 29/25.42; 29/830; 29/831; 29/832; 347/71

(58) Field of Classification Search ..... 29/25.35, 29/25.42, 890.1, 846, 832, 831; 310/328, 310/311, 358, 313.12; 347/68, 70, 71; 216/27
See application file for complete search history.

(56) References Cited

U.S. PATENT DOCUMENTS 6,198,203 B1 3/2001 Hotomi
6,254,223 B1 7/2001 Kim et al.
6,494,567 B2 * 12/2002 Murai ..... 347/71
6,499,837 B2 * 12/2002 Murai ..... 347/71

(Continued)

FOREIGN PATENT DOCUMENTS

JP A 9-277523 10/1997

(Continued)

OTHER PUBLICATIONS

Notice of Reasons for Rejection issued in Japanese Patent Application No. 2004-106538; mailed Mar. 16, 2010; with English-language translation.

*Primary Examiner*—Derris H Banks
*Assistant Examiner*—Tai Nguyen
(74) *Attorney, Agent, or Firm*—Oliff & Berridge, PLC

(57) ABSTRACT

A method for producing an ink-jet head includes forming a buffer layer on an upper surface of a vibration plate, and forming a piezoelectric precursor layer on an entire upper surface of a surface layer, the piezoelectric precursor layer being converted into a piezoelectric sheet. The buffer layer is formed of a material with which mutual diffusion between the piezoelectric precursor layer and the buffer layer is hardly caused as compared with mutual diffusion between the piezoelectric precursor layer and the vibration plate with which no buffer layer is provided. A stack, in which the buffer layer and the piezoelectric precursor layer are formed, is heated at a predetermined temperature, and the piezoelectric precursor layer is calcinated to form the piezoelectric sheet. It is possible to suppress the deterioration of the performance of the piezoelectric member.

15 Claims, 5 Drawing Sheets

U.S. PATENT DOCUMENTS

| | | | | |
|---|---|---|---|---|
| 6,504,287 | B2 | 1/2003 | Yun et al. | |
| 6,811,248 | B2 | 11/2004 | Matsuo et al. | |
| 2003/0112300 | A1 | 6/2003 | Chung et al. | |
| 2006/0049135 | A1 * | 3/2006 | Okabe et al. | 216/27 |
| 2006/0119226 | A1 * | 6/2006 | Nihei | 310/341 |
| 2007/0019042 | A1 | 1/2007 | Chung et al. | |

FOREIGN PATENT DOCUMENTS

| | | |
|---|---|---|
| JP | A-11-334087 | 12/1999 |
| JP | A 2003-53974 | 2/2003 |
| JP | A 2003-237091 | 8/2003 |

* cited by examiner

METHOD FOR PRODUCING INK-JET HEAD AND INK-JET HEAD

This application is a division of U.S. patent application Ser. No. 11/090,843, filed Mar. 25, 2005, the entire contents of which are hereby incorporated by reference.

BACKGROUND OF THE INVENTION

1. Field of the Invention

The present invention relates to a method for producing an ink-jet head for discharging an ink onto a recording medium. The present invention also relates to the ink-jet head.

2. Description of the Related Art

Japanese Patent Application Laid-open No. 11-334087 (FIG. 1) describes a method for producing an ink-jet head including a vibration plate and a piezoelectric film formed on the vibration plate wherein the vibration plate is continuously formed on a substrate arranged with a plurality of pressure chambers to have such a size that all of the pressure chambers are covered with the vibration plate, the vibration plate and the piezoelectric film being composed of metal materials having coefficients of thermal expansion similar to one another. According to this method, when the piezoelectric film is formed on the vibration plate, a stack or laminate, which is composed of the vibration plate and the piezoelectric film, is suppressed from causing any warpage which would be otherwise caused by the difference between the coefficients of thermal expansion of the vibration plate and the piezoelectric film.

However, in the case of the method for producing the ink-jet head described in Japanese Patent Application Laid-open No. 11-334087, any mutual diffusion occurs between the materials for constructing the vibration plate and the piezoelectric film, and the crystal growth of the piezoelectric film is inhibited during the calcination of the piezoelectric film, when the piezoelectric film is thermally formed or calcinated on the vibration plate. As a result, the performance of the piezoelectric film is deteriorated.

SUMMARY OF THE INVENTION

In view of the above, an object of the present invention is to provide a method for producing an ink-jet head and the ink-jet head which suppress the deterioration of the performance of a piezoelectric member.

According to a first aspect of the present invention, there is provided a method for producing an ink-jet head, comprising the steps of:

manufacturing a flow passage unit including a vibration plate which is made of metal, an ink chamber which is closed by the vibration plate, and a nozzle which is communicated with the ink chamber and which discharges an ink;

forming a first buffer layer on the vibration plate;

forming a piezoelectric precursor on the first buffer layer; and heating the flow passage unit, the first buffer layer, and the piezoelectric precursor so that the piezoelectric precursor is calcinated into a piezoelectric member, wherein:

the first buffer layer is formed of a metal material with which mutual diffusion between the first buffer layer and the piezoelectric precursor during the heating is less than mutual diffusion between the piezoelectric precursor and the vibration plate when the heating is performed without the first buffer layer.

Accordingly, the first buffer layer, which is composed of the metal material with which the mutual diffusion of the material with respect to the piezoelectric precursor is hardly caused as compared with the vibration plate, is allowed to intervene between the piezoelectric precursor and the vibration plate. Therefore, the mutual diffusion is hardly caused between the material for constructing the piezoelectric precursor and the material for constructing the vibration plate during the heating step. As a result, the crystal growth of the piezoelectric precursor is easily advanced in the heating step, and the performance of the piezoelectric member to be obtained is hardly deteriorated.

In the present invention, the method for producing the ink-jet head may further comprise, before the heating step, a step of forming, on the first buffer layer, a second buffer layer formed of a metal material with which mutual diffusion between the second buffer layer and the piezoelectric precursor during the heating is less than the mutual diffusion between the vibration plate and the piezoelectric precursor when the heating is performed without the second buffer layer. Accordingly, the mutual diffusion is effectively prevented in the heating step between the material for constructing the piezoelectric precursor and the material for constructing the vibration plate.

In the present invention, it is also preferable that the second buffer layer may have oxidation resistance which is equivalent to or greater than that of the vibration plate. Accordingly, any oxide film is hardly formed between the second buffer layer and the piezoelectric precursor in the heating step, because the second buffer layer is excellent in the oxidation resistance. Therefore, it is possible to apply a sufficient electric field to the piezoelectric member and the vibration plate.

In the present invention, the vibration plate may be formed of any one of materials of stainless steel, titanium, and 42 Alloy, and the heating may be performed in the heating step at a temperature of 600° C. to 900° C. Accordingly, the metal, which constitutes the vibration plate, hardly causes the decrease in the strength.

In the present invention, the first buffer layer may be formed of nickel. Nickel is cheap, and hence it is possible to decrease the production cost of the ink-jet head.

In the present invention, the second buffer layer may be formed of gold. Gold has the excellent oxidation resistance and the excellent thermal stability. Therefore, the mutual diffusion is hardly caused between the piezoelectric precursor and the vibration plate in the heating step. Further, any oxide film is hardly formed between the second buffer layer and the piezoelectric precursor.

According to a second aspect of the present invention, there is provided a method for producing an ink-jet head, comprising the steps of:

manufacturing a flow passage unit including a vibration plate which is made of metal, an ink chamber which is closed by the vibration plate, and a nozzle which is communicated with the ink chamber and which discharges an ink;

forming a nickel layer on the vibration plate;

forming a gold layer on the nickel layer;

forming a piezoelectric precursor on the gold layer; and heating the flow passage unit, the nickel layer, the gold layer, and the piezoelectric precursor at a temperature of 600° C. to 900° C. so that the piezoelectric precursor is calcinated into a piezoelectric member. Accordingly, the nickel layer and the gold layer intervene between the vibration plate and the piezoelectric member. Gold has the excellent oxidation resistance and the excellent thermal stability. Nickel has such a property that it hardly inhibits the crystal growth of the piezoelectric precursor. Therefore, the mutual diffusion is hardly caused between the piezoelectric precursor and the vibration plate as a whole in the heating step. Further, any oxide film is hardly formed with respect to the piezoelectric precursor. As a result, the crystallization of the piezoelectric precursor is advanced, and the performance of the piezoelectric member is hardly deteriorated. Further, nickel is cheap, and hence it is possible to decrease the production cost of the ink-jet head.

According to a third aspect of the present invention, there is provided an ink-jet head comprising:

a flow passage unit which includes a vibration plate made of metal, an ink chamber closed by the vibration plate, and a nozzle communicated with the ink chamber to discharge an ink;

a first buffer layer which is formed on the vibration plate; and a piezoelectric member which is formed on the first buffer layer and which is obtained by calcinating a piezoelectric precursor, wherein:

the first buffer layer is formed of a metal material with which mutual diffusion between the piezoelectric precursor and the first buffer layer during heating for the calcination is less than mutual diffusion between the piezoelectric precursor and the vibration plate when the heating is performed without the first buffer layer. Accordingly, the first buffer layer, which is composed of such a metal material that the mutual diffusion of the material with respect to the piezoelectric precursor is hardly caused as compared with the vibration plate, is allowed to intervene between the piezoelectric precursor and the vibration plate. Therefore, the head is provided, in which the mutual diffusion is hardly caused between the material for constructing the piezoelectric precursor and the material for constructing the vibration plate. Thus, the head is provided, in which the decrease in the piezoelectric characteristic of the piezoelectric member is suppressed.

In the present invention, the ink-jet head may further comprise a second buffer layer which is formed between the first buffer layer and the piezoelectric member and which is formed of a metal material with which mutual diffusion between the second buffer layer and the piezoelectric precursor during the heating is less than the mutual diffusion between the vibration plate and the piezoelectric precursor when the heating is performed without the second buffer layer. Accordingly, the mutual diffusion between the material for constructing the piezoelectric precursor and the material for constructing the vibration plate is effectively prevented. The head is provided, in which the crystallization of the piezoelectric precursor is further advanced.

In the present invention, the second buffer layer may have oxidation resistance which is equivalent to or greater than that of the vibration plate. Accordingly, any oxide film is hardly formed between the second buffer layer and the piezoelectric precursor. Therefore, it is possible to apply a sufficient electric field to the piezoelectric member and the vibration plate.

According to still another aspect of the present invention, there is provided an ink-jet printer comprising the ink-jet head according to the third aspect of the present invention.

BRIEF DESCRIPTION OF THE DRAWINGS

FIGS. 6A to 6D show parts of the steps of producing the ink-jet head according to the embodiment of the present invention, wherein FIG. 6A shows a situation in which a stack is formed by four plates except for a nozzle plate, FIG. 6B shows a situation in which a first buffer layer is formed on an upper surface of an actuator plate and a second buffer layer is formed on the first buffer layer, FIG. 6C shows a situation in which a piezoelectric sheet is formed on the second buffer layer, and FIG. 6D shows a situation in which an individual electrode is formed on the piezoelectric sheet.

DESCRIPTION OF THE PREFERRED EMBODIMENTS

A preferred embodiment of the present invention will be explained below with reference to the drawings.

Figure 1:
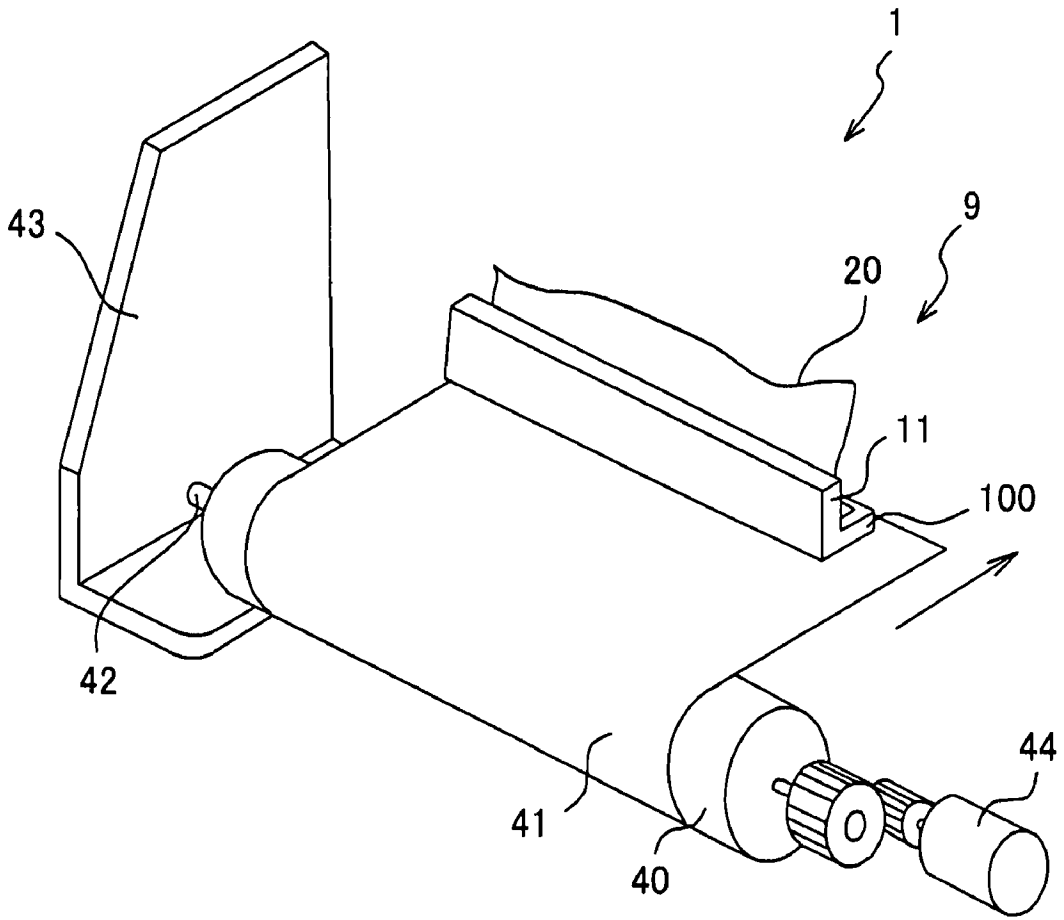
FIG. 1 shows a perspective view illustrating a schematic arrangement of an ink-jet printer including an ink-jet head according to an embodiment of the present invention.

FIG. 1 shows a perspective view illustrating a schematic arrangement of an ink-jet printer including an ink-jet head according to an embodiment of the present invention. As shown in FIG. 1, the ink-jet printer 1 comprises a platen roller 40 which transports the printing paper 41 as a recording medium, an ink-jet head 9 which discharges an ink onto the printing paper 41 set on the platen roller 40, and a flexible printed circuit (FPC) 20 which supplies a driving voltage from a control unit (not shown) to the ink-jet head 9.

The platen roller 40 is rotatably attached to a frame 43 by the aid of a shaft 42, and is driven and rotated by a motor 44. The printing paper 41 is fed from a paper feed cassette (not shown) which is provided in the vicinity of the ink-jet printer 1. The printing paper 41 is transported at a constant speed in the direction of the arrow shown in the drawing by the aid of the platen roller 40. Predetermined printing operation is performed with the ink discharged from the ink-jet head 9. After that, the printing paper 41 is discharged. Detailed illustrations of a paper feed mechanism and a paper discharge mechanism for the printing paper 41 are omitted from FIG. 1. The ink-jet printer 1, which is depicted in FIG. 1, is a monochrome or black and white printer in which only one ink-jet head 9 is arranged. However, when the color printing is performed, at least four ink-jet heads 9 of yellow, magenta, cyan, and black are arranged in parallel.

As appreciated from FIG. 1, the ink-jet head 9 is a line head which extends perpendicularly to the transport direction of the printing paper 41, and it is installed and fixed to the frame 43. The ink-jet head 9 is provided to discharge the ink onto the printing paper 41. The ink-jet head 9 has a head main body 100 and a base section 11. The head main body 100 extends in a form of line in one direction (direction perpendicular to the transport direction of the printing paper). The base section 11 extends in a direction perpendicular to the head main body 100, and it supports the head main body 100.

An ink discharge surface of the head main body 100, which is the bottom surface of the ink-jet head 9 and on which a large number of nozzles 8 (see FIG. 3) are formed in an array in the longitudinal direction, is opposed in parallel to the transport surface of the printing paper 41 to be transported by the platen roller 40. Therefore, when the driving voltage is supplied from the control unit via FPC 20 to the head main body 100, the ink, which is discharged from the respective nozzles 8 formed on the ink discharge surface of the head main body 100, flies toward the printing paper 41. FPC 20 is electrically connected to a piezoelectric sheet 21 at the upper surface of the head main body 100 as described later on.

Figure 2:
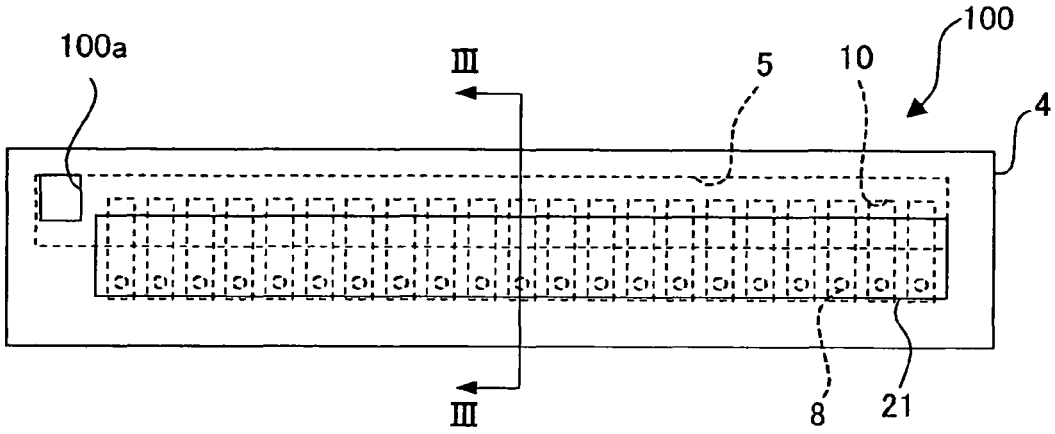
FIG. 2 shows a plan view illustrating a head main body shown in FIG. 1.

Next, the head main body 100 will be explained below. FIG. 2 shows a plan view illustrating the head main body 100. As shown in FIG. 2, the head main body 100 has a flow passage unit 4 and the piezoelectric sheet (piezoelectric member) 21 which is formed on the upper surface of the flow passage unit 4. As shown in FIG. 2, the flow passage unit 4 has a rectangular planar shape extending in one direction. A manifold 5, which extends in parallel to the longitudinal direction of the flow passage unit 4, is formed in the flow passage unit 4. An ink supply port 100*a* is formed at one end (left side end of the flow passage unit 4 as shown in FIG. 2) of the head main body 100. The ink supply port 100*a* is communicated with the manifold 5. The ink supply port 100*a* is connected to an unillustrated ink tank via a tube or the like, and thus the ink is supplied from the ink tank to the manifold 5.

The piezoelectric sheet 21, which has a rectangular planar shape, is formed at an approximately central portion of the upper surface of the flow passage unit 4 with no interference with the ink supply port 100*a*. A large number of pressure chambers (ink chambers) 10, which are arranged in the longitudinal direction of the flow passage unit 4, are formed in the flow passage unit 4 disposed opposingly to the piezoelectric sheet 21. In other words, the piezoelectric sheet 21 has such a dimension that the piezoelectric sheet 21 ranges over all of the pressure chambers 10.

The pressure chamber 10, which is formed in the flow passage unit 4, has a rectangular planar shape with its longitudinal direction being parallel to the transverse direction of the flow passage unit 4. One end of the pressure chamber 10 is communicated with the nozzle 8, and the other end is communicated with the manifold 5. Accordingly, a large number of individual ink flow passages 7, which are formed for the respective pressure chambers 10 while being communicated with the nozzles 8, are connected to the manifold 5.

Figure 3:
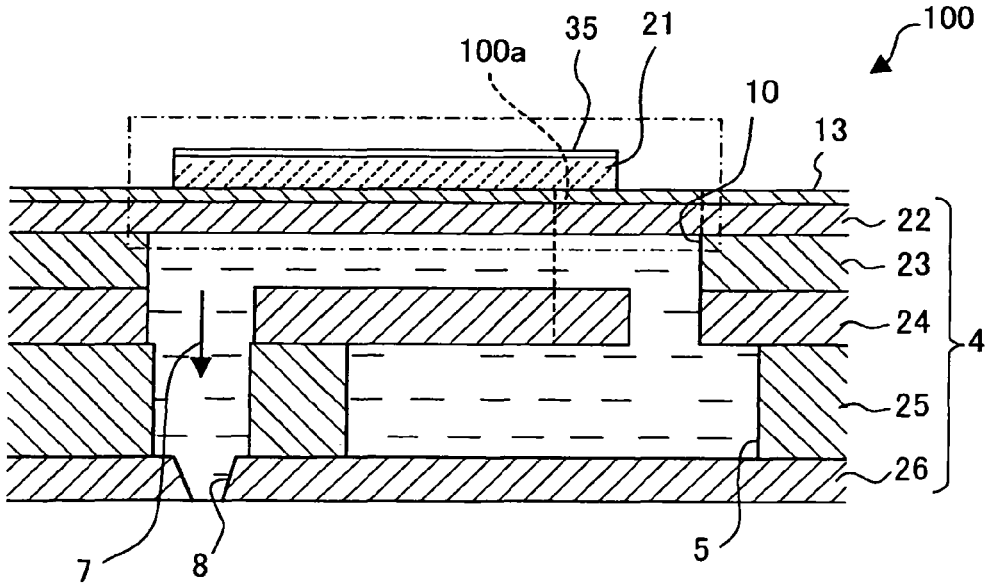
FIG. 3 shows a partial sectional view taken along a line III-III shown in FIG. 2.

FIG. 3 shows a sectional view illustrating one of the individual ink flow passages, which is a partial sectional view taken along a line III-III shown in FIG. 2. As appreciated from FIG. 3, each of the nozzles 8 is communicated with the manifold 5 via the pressure chamber 10. That is, one flow passage, which arrives at the nozzle 8 from the outlet of the manifold 5 via the pressure chamber 10, is constructed. In this manner, the individual ink flow passage 7 is formed for each of the pressure chambers 10 in the head main body 100.

As shown in FIG. 3, the head main body 100 has a stacked structure in which six in total of sheet members, i.e., the uppermost piezoelectric sheet 21, an actuator plate (vibration plate) 22, a cavity plate 23, a supply plate 24, a manifold plate 25, and a nozzle plate 26 are stacked in this order. The flow passage unit 4 is constructed by five of these plates except for the piezoelectric sheet 21.

A plurality of individual electrodes 35 are formed on the upper surface of the piezoelectric sheet 21 as described in detail later on. The piezoelectric sheet 21 has portions which serve as active sections to be opposed to the individual electrodes 35 when the driving voltage is applied to the respective individual electrodes 35.

The actuator plate 22 is a metal plate which is provided with a hole to serve as the ink supply port 100*a*. The cavity plate 23 is a metal plate which is provided with a hole to serve as a communication hole from the ink supply port 100*a* to the manifold 5 and which is also provided with a large number of holes for constructing the pressure chambers 10, the holes being formed in areas opposed to the piezoelectric sheet 21. The supply plate 24 is a metal plate which is provided with a hole to serve as a communication hole from the ink supply port 100*a* to the manifold 5 and which is also provided with communication holes from the manifold 5 to the pressure chambers 10 and communication holes from the pressure chambers 10 to the nozzles 8 respectively for each one of the pressure chambers 10 of the cavity plate 23. The manifold plate 25 is a metal plate which is provided with the manifold 5 and which is additionally provided with communication holes from the pressure chambers 10 to the nozzles 8 respectively for each one of the pressure chambers 10 of the cavity plate 23. The nozzle plate 26 is a resin plate which is provided with the nozzles 8 respectively for each one of the pressure chambers 10 of the cavity plate 23.

The five plates 22 to 26 are stacked while being positionally aligned to one another so that the individual ink flow passages 7 are formed as shown in FIG. 3. The individual ink flow passage 7 is firstly directed upwardly from the manifold 5, extends horizontally in the pressure chamber 10, and is directed vertically downwardly to the nozzle 8. Among the five plates for constructing the flow passage unit 4, the four plates except for the nozzle plate 26 are composed of metal materials composed of stainless steel in this embodiment. However, they may be composed of metal materials such as 42 Alloy and titanium. The reason, why the stainless steel is applied as the metal materials for the respective plates 22 to 25 in this embodiment, is as follows. That is, the coefficient of thermal expansion of 42 Alloy is approximate to that of the piezoelectric sheet 21, and 42 Alloy is satisfactory in the fine etching processability. However, 42 Alloy is inferior in the corrosion resistance against the ink. On the other hand, the coefficient of thermal expansion of titanium is small, and titanium is satisfactory in the corrosion resistance against the ink. However, titanium is unsatisfactory in the fine etching processability. On the contrary, stainless steel is satisfactory in oxidation resistance, with which the mechanical strength is lowered to a small extent even in the case of the high temperature processing. Stainless steel is satisfactory in the fine etching processability when the pressure chambers 10 or the like are formed. Stainless steel is not inferior in the fine etching processability and the corrosion resistance as compared with 42 Alloy and titanium. The nozzle plate 26 is composed of polyimide resin. However, the nozzle plate 26 may be composed of any other resin material or the same metal material as that of each of the other plates 22 to 25.

Figure 4:
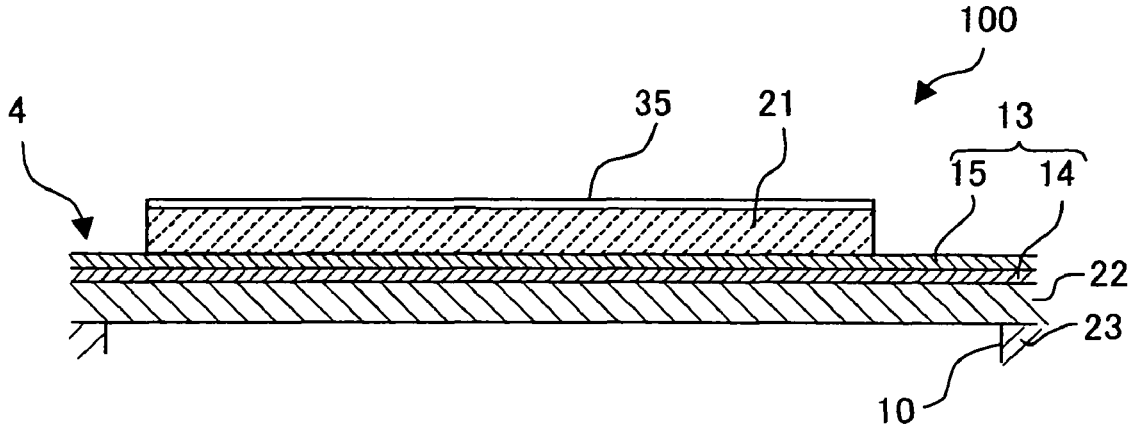
FIG. 4 shows a magnified view illustrating an area surrounded by dashed lines depicted in FIG. 3.

FIG. 4 shows a magnified view illustrating an area surrounded by dashed lines depicted in FIG. 3. As shown in FIG. 4, a surface layer 13 is formed on the entire upper surface of the actuator plate 22. The actuator plate 22 and the piezoelectric sheet 21 are joined to each other with the surface layer 13 intervening therebetween. In this embodiment, the surface layer 13 includes a first buffer layer 14 which is formed on the side of the actuator plate 22, and a second buffer layer 15 which is formed on the side of the piezoelectric sheet 21. Both of the first and second buffer layers 14, 15 are composed of metal materials which hardly cause the mutual diffusion with respect to the piezoelectric sheet 21. The first buffer layer 14 is composed of nickel which hardly causes the mutual diffusion with respect to the piezoelectric sheet 21 as compared with the stainless steel which constructs the actuator plate 22. The second buffer layer 15 is composed of gold which also hardly causes the mutual diffusion with respect to the piezoelectric sheet 21 as compared with the stainless steel which constructs the actuator plate 22 in the same manner as the first buffer layer 14.

In this manner, the actuator plate 22 and the piezoelectric sheet 21 are joined to each other with the surface layer 13 intervening therebetween by joining the actuator plate 22 to the first buffer layer 14, joining the first buffer layer 14 to the second buffer layer 15, and joining the piezoelectric sheet 21 to the second buffer layer 15.

As shown in FIG. 2, the piezoelectric sheet 21 is a flat plate which is arranged to range over the large number of pressure chambers 10 of the flow passage unit 4. When the piezoelectric sheet 21 is arranged to range over the large number of pressure chambers 10, the individual electrodes 35 can be arranged at a high density on the piezoelectric sheet 21 by using, for example, the screen printing technique. Therefore, the pressure chambers 10, which are formed at the positions corresponding to the individual electrodes 35, can be also arranged at a high density. Thus, it is possible to print an image at a high resolution. In this embodiment, the piezoelectric sheet 21 is composed of a ceramic material based on the lead titanate zirconate (PZT) system having ferroelectricity. However, the piezoelectric sheet 21 may be composed of materials including, for example, those based on the lead magnesium niobate (PMN) system, the lead nickel niobate (PNN) system, lead manganese niobate, lead antimony stannate, lead zinc niobate, and lead titanate.

Each one of the individual electrodes 35 is formed in the area opposed to each of the pressure chambers 10 on the upper surface of the piezoelectric sheet 21. That is, the individual electrodes 35 are arranged in the longitudinal direction of the flow passage unit 4 in the same manner as the pressure chambers 10. The individual electrodes 35 are isolated from each other so that they are independent from one another. The individual electrodes 35 are composed of a metal material such as Ag—Pd system, and they are electrically connected to independent wirings formed in FPC 20 respectively. Accordingly, the control unit can control the electric potential for each of the pressure chambers 10 via the wirings of the FPC 20. The actuator plate 22 is always maintained at the ground electric potential, and it functions as a common electrode.

Next, a method for driving the actuator unit 21 will be described. The piezoelectric sheet 21 is polarized in the thickness direction thereof. Therefore, when an electric potential, which is higher than the ground electric potential, is applied to the individual electrode 35, an electric field is applied to the piezoelectric sheet 21 in the direction of polarization. When the electric field is applied to the piezoelectric sheet 21, the portion, to which the electric field is applied, acts as the active layer which is elongated in the thickness direction and which intends to contract in the surface direction in accordance with the lateral piezoelectric effect. Accordingly, the piezoelectric sheet 21 and the actuator plate 22 are deformed to project toward the pressure chamber (unimorph deformation). In this situation, as shown in FIG. 3, the lower surface of the actuator plate 22 is fixed to the upper surface of the partition wall (cavity plate) 23 which comparts the pressure chamber 10. As a result, the piezoelectric sheet 21 and the actuator plate 22 are deformed to project toward the pressure chamber. Therefore, the volume of the pressure chamber 10 is decreased, the pressure of the ink is increased, and the ink is discharged from the nozzle 8. After that, when the individual electrode 35 is returned to have the same electric potential as that of the actuator plate 22 which functions as the common electrode, then the piezoelectric sheet 21 and the actuator plate 22 are allowed to have the original shapes, and the volume of the pressure chamber 10 is returned to the original volume. Therefore, the ink is sucked from the manifold 5.

Another driving method is also available as follows. That is, the individual electrode 35 is previously allowed to have an electric potential which is different from that of the actuator plate 22 which serves as the common electrode. Every time when the discharge request is made, then the individual electrode 35 is once allowed to have the same electric potential as that of the actuator plate 22, and then the individual electrode 35 is allowed to have the electric potential which is different from that of the actuator plate 22 again at a predetermined timing. In this procedure, the piezoelectric sheet 21 and the actuator plate 22 are returned to have the original shapes at the timing at which the individual electrode 35 is allowed to have the same electric potential as that of the actuator plate 22. Accordingly, the volume of the pressure chamber 10 is increased as compared with the initial state, and the ink is sucked from the manifold 5 into the pressure chamber 10. After that, the individual electrode is applied with a potential at a timing different from the timing when the actuator plate 22 is applied with the potential so that the piezoelectric sheet 21 and the actuator plate 22 are deformed to project toward the pressure chamber 10. The pressure of the ink is increased in accordance with the decrease in the volume of the pressure chamber 10, and the ink is discharged. Thus, the ink is discharged from the nozzles 8, and a desired image is printed on the transported printing paper 41.

Figure 5:
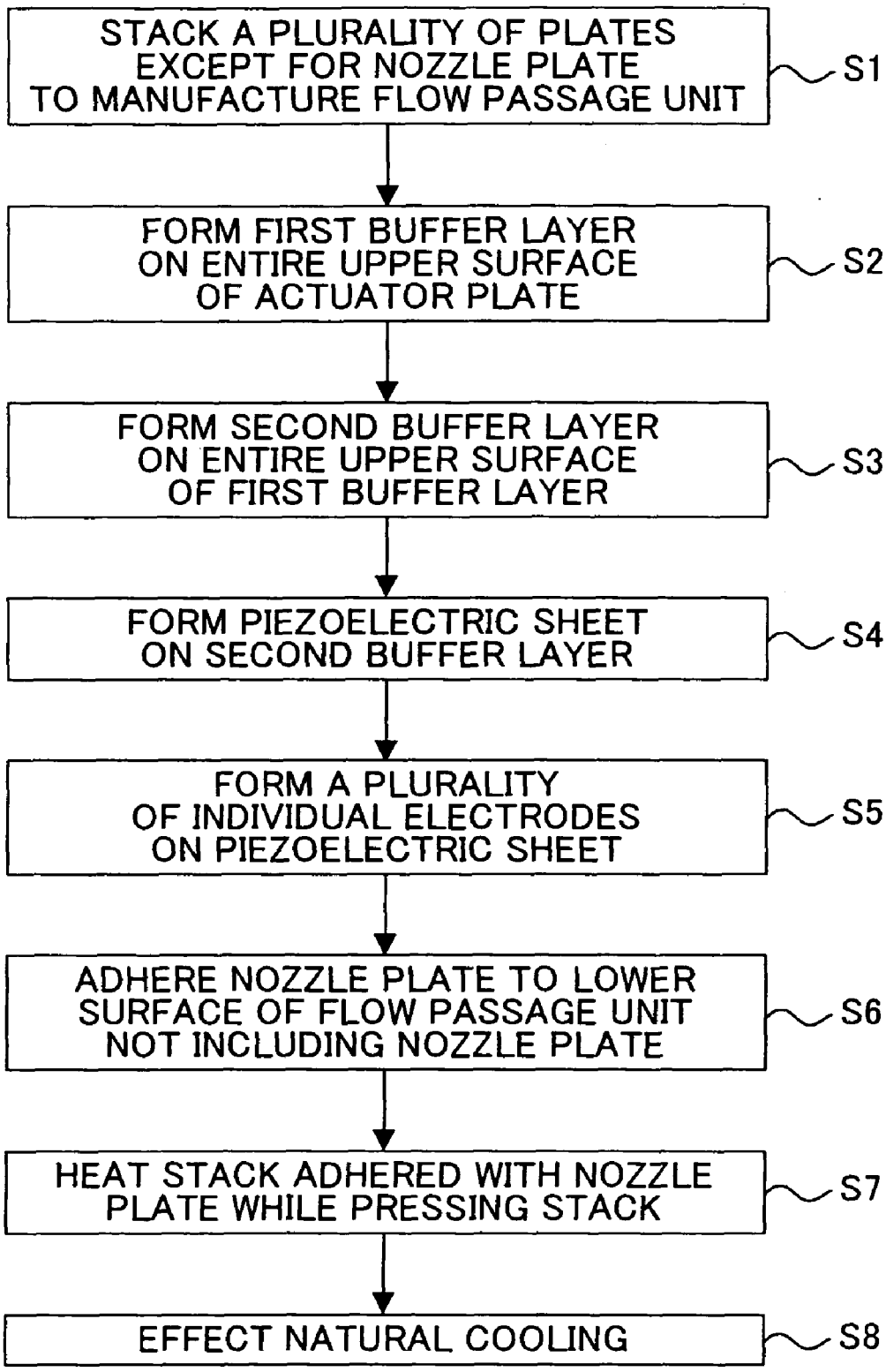
FIG. 5 shows steps of producing the ink-jet head.

Next, an explanation will be made with reference to FIG. 5 about a method for producing the ink-jet head 9 described above. FIG. 5 shows steps of producing the ink-jet head 9. FIG. 6 shows parts of the steps of producing the ink-jet head 9 according to the embodiment of the present invention, wherein FIG. 6A shows a situation in which a stack is formed by the four plates except for the nozzle plate, FIG. 6B shows a situation in which the first buffer layer is formed on the upper surface of the actuator plate 22 and the second buffer layer is formed on the first buffer layer, FIG. 6C shows a situation in which the piezoelectric sheet is formed on the second buffer layer, and FIG. 6D shows a situation in which the individual electrode is formed on the piezoelectric sheet.

Figure 6A:
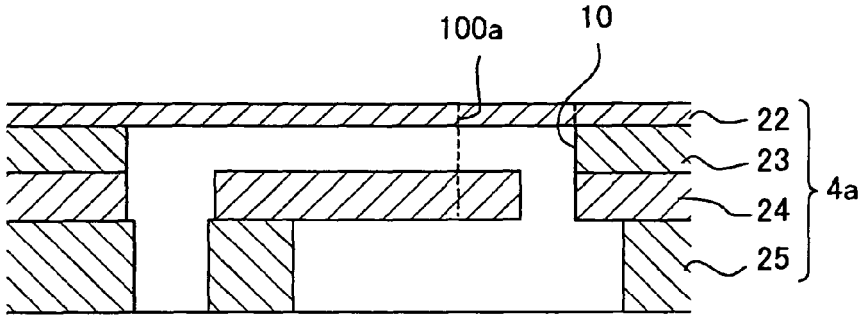

When the ink-jet head 9 is produced, a stack 4*a*, which is to form the flow passage unit 4 not including the nozzle plate 26, is firstly manufactured in Step 1 (S1) as shown in FIG. 6A. In order to manufacture the stack 4*a*, the etching is applied by using masks of photoresists subjected to the patterning on the respective plates 22 to 25 for constructing the stack 4*a* to form the holes as shown in FIG. 3 for the respective plates 22 to 25. The four plates 22 to 25, which are positionally adjusted so that the individual ink flow passages 7 are formed, are pressed and heated in an overlapped state so that the respective plates 22 to 25 are joined to one another while effecting the diffusion.

Figure 6B:
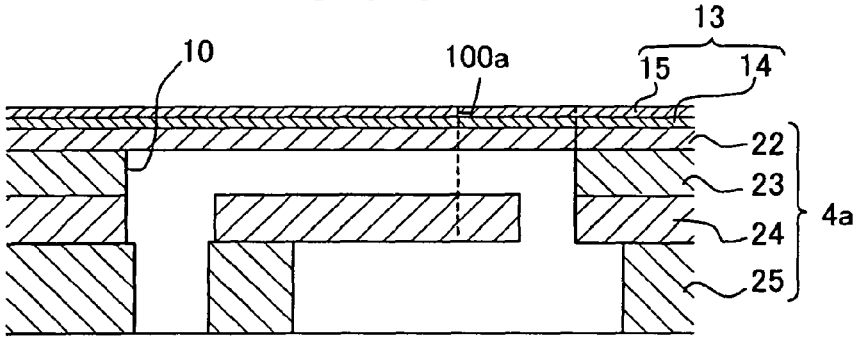

Subsequently, in Step 2 (S2), the first buffer layer 14, which is composed of nickel, is formed by the electroplating method on the entire upper surface of the actuator plate 22 as shown in FIG. 6B. In Step 3 (S3), as shown in FIG. 6B, the second buffer layer 15, which is composed of gold, is formed by the electroplating method on the entire upper surface of the first buffer layer 14. Thus, the surface layer 13, which is composed of the first and second buffer layers 14, 15, is formed. In this manner, it is possible to form, on the upper surface of the actuator plate 22, the surface layer 13 composed of nickel and gold in which the mutual diffusion hardly occurs to such an extent that the crystal growth of the piezoelectric precursor layer (described later on) is inhibited, as compared with the stainless steel for constructing the actuator plate 22. Accordingly, the crystal growth of the piezoelectric precursor layer is advanced without being inhibited in accordance with the heating step as described later on, and it is possible to obtain the piezoelectric sheet 21 which has the satisfactory piezoelectric performance. In this embodiment, the electroplating method is used as the method for forming the first and second buffer layers 14, 15. However, it is also allowable to apply any known method other than the above, including, for example, the vapor growth method such as the sputtering and the vapor deposition, and the screen printing method based on the use of metal paste.

Figure 6C:
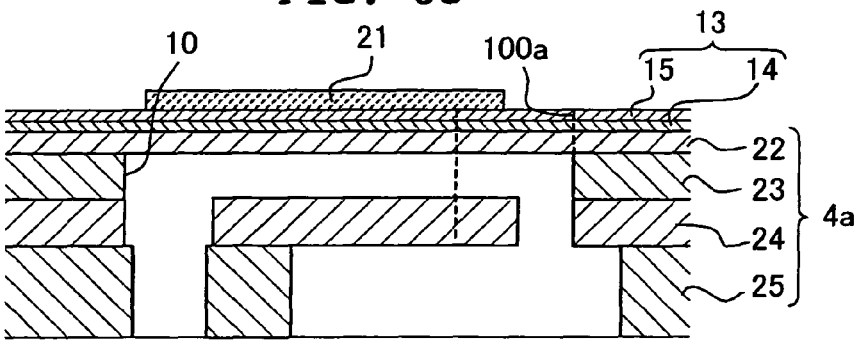
Figure 6D:
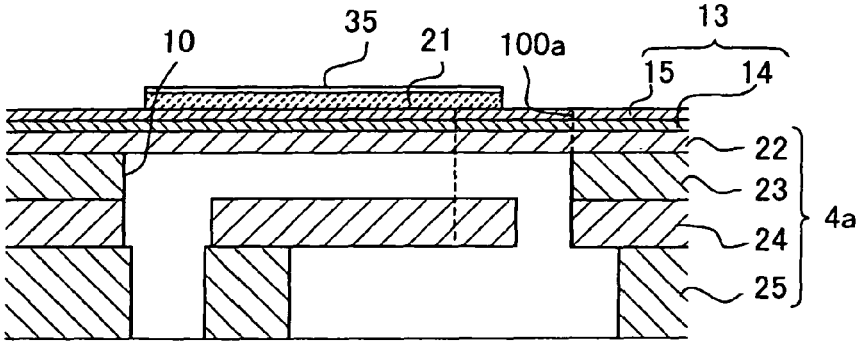

Subsequently, in Step 4 (S4), as shown in FIG. 6C, a piezoelectric material paste is screen-printed to range over all of the pressure chambers 10 on the upper surface of the second buffer layer 15 to form the piezoelectric precursor layer which is to be converted into the piezoelectric sheet 21 having a thickness of about 20 μm. The stack, which is composed of the stack 4*a* and the piezoelectric precursor layer, is subjected to a degreasing treatment at 500° C. for 1 hour, followed by being subjected to a heating treatment at 850° C. for 10 minutes to calcinate the piezoelectric precursor layer thereby. Accordingly, the piezoelectric precursor layer is converted into the piezoelectric sheet 21 having a thickness of about 15 μm. In this procedure, it is preferable that a predetermined temperature in the heating step of heating the piezoelectric precursor layer is not less than 600° C. and not more than 900° C. If the predetermined temperature is less than 600° C., then the crystal growth, which is caused by the calcination of the piezoelectric precursor layer, becomes coarse, and the piezoelectric performance of the piezoelectric sheet 21 is deteriorated. On the other hand, if the predetermined temperature exceeds 900° C., the strength is lowered, because the actuator plate 22 is composed of the metal material (stainless steel). In other words, when the heating temperature for the piezoelectric precursor layer is not less than 600° C. and not more than 900° C., then it is possible to avoid the inconveniences as described above, and it is possible to hardly cause the deterioration of the piezoelectric performance of the piezoelectric sheet 21 and the decrease in the strength of the actuator plate 22.

In this embodiment, the piezoelectric material paste is obtained by mixing, for example, a piezoelectric material powder based on the PZT system, minor components such as a sintering aid, ethyl cellulose as a binder, and terpineol as an organic solvent into a paste form. An easily sinterable material, which is capable of being sintered at a low temperature, is desirably used as the PZT-based piezoelectric material powder which serves as a base for the piezoelectric material paste, in order to successfully use the actuator plate 22 made of metal. The reactivity possessed by particles, i.e., the surface energy is inversely proportional to the particle size or diameter, and the porosity, which is obtained when the particles are packed most closely, is also inversely proportional to the particle size. Therefore, in this embodiment, the particles are desirably to have small particle sizes, and the average particle size is not more than about 0.5 μm and preferably not more than 0.2 μm. As described above, the piezoelectric material powder based on the PZT system (i.e., the material for the formation as the base for the piezoelectric sheet 21) may be replaced, for example, with those based on the lead magnesium niobate system other than those based on the lead zirconate titanate system.

In this embodiment, the screen printing method is used to form the piezoelectric precursor layer to be converted into the piezoelectric sheet 21. However, it is possible to apply other known methods including, for example, the spin coating method, the dipping method, the cast method, the doctor blade method, the aerosol position method, the sol-gel method, and the organic compound pyrolysis method. Further, it is also possible to apply the transfer method. When the transfer method is applied, a piezoelectric material paste, which is prepared in the same manner as described above, is firstly used to prepare a green sheet for which the thickness is managed, for example, by the doctor blade method or the cast method. The green sheet is punched on a surface of a resin sheet having a high exfoliating property spread on a surface plate or the like, for example, by the press method to have a desired shape, and thus a piezoelectric precursor layer is formed. The piezoelectric precursor layer is pressed while being positioned with respect to the upper surface of the actuator plate 22. Accordingly, the piezoelectric precursor layer on the resin sheet can be transferred onto the actuator plate 22.

Subsequently, in Step 5 (S5), as shown in FIG. 6D, a silver-based conductive paste is screen-printed to form a pattern of the individual electrodes 35 on the piezoelectric sheet 21, followed by being dried. After that, a stack, which is composed of the stack 4*a*, the piezoelectric sheet 21, and the silver-based conductive paste, is heated and treated at 850° C. for 10 minutes. Thus, the silver-based conductive paste is calcinated to form the individual electrodes 35 on the piezoelectric sheet 21.

Subsequently, in Step 6 (S6), the nozzle plate 26 made of polyimide resin, through which the plurality of nozzles 8 are formed by the laser machining, is adhered with an epoxy-based thermosetting adhesive to the lower surface of the stack which is composed of the stack 4*a*, the piezoelectric sheet 21, and the individual electrodes 35. Subsequently, in Step 7 (S7), the stack, to which the nozzle plate 26 has been adhered, is pressed while being heated to a temperature of not less than the curing temperature of the thermosetting adhesive by using an unillustrated heating and pressing apparatus. In Step 8 (S8), the stack, which is taken out from the heating and pressing apparatus, is cooled naturally. Thus, the head main body 100, which is constructed by the flow passage unit 4 and the piezoelectric sheet 21, is produced.

After that, the ink-jet head 9 as described above is completed by performing, for example, a step of joining the head main body 100 and the base section 11. After that, a step of adhering FPC 20 and the piezoelectric sheet 21 is performed, and then the ink-jet head 9 is fixed via the base section 11 to the frame 43 to which the paper feed mechanism, the paper discharge mechanism, and other components are assembled. Thus, the ink-jet printer 1 is produced.

According to the method for producing the ink-jet head 9 as described above, the surface layer 13 is allowed to intervene between the piezoelectric sheet 21 and the actuator plate 22, and in the surface layer 13 the mutual diffusion is hardly caused to such an extent that the piezoelectric precursor layer, which is to be converted into the piezoelectric sheet 21, is inhibited for the crystal growth, as compared with the actuator plate 22. Therefore, it is possible to avoid the occurrence of any harmful influence which would be otherwise caused by the mutual diffusion between the material for constructing the piezoelectric precursor layer and the material for constructing the actuator plate 22 in the heating step of calcinating the piezoelectric precursor layer to form the piezoelectric sheet 21. In other words, the first and second buffer layers 14, 15, which constitute the surface layer 13, are composed of nickel and gold, respectively, which scarcely exert the harmful influence which would be otherwise caused by the mutual diffusion between the piezoelectric precursor layer and the both of nickel and gold, when the piezoelectric precursor layer, which is to be converted into the piezoelectric sheet 21, is heated. Therefore, even when the piezoelectric sheet 21 is calcinated on the actuator plate 22, the piezoelectric sheet 21 is obtained, in which the crystal growth of the piezoelectric precursor layer is advanced satisfactorily. As a result, the deterioration of the performance of the piezoelectric sheet 21 is hardly caused. The ink-jet head 9, which is produced as described above, has the piezoelectric sheet 21 in which the performance is scarcely deteriorated.

The second buffer layer 15 is formed on the first buffer layer 14. Therefore, the mutual diffusion is hardly caused between the material for constructing the piezoelectric precursor layer and the material for constructing the actuator plate 22 in the heating step. Accordingly, any harmful influence, which would be otherwise caused by the mutual diffusion, is mitigated. The second buffer layer 15, which is composed of gold, is excellent in the thermal stability and the oxidation resistance. Therefore, it is possible to suppress the harmful influence which would be otherwise exerted by the mutual diffusion between the piezoelectric precursor layer and the actuator plate 22. Further, any oxide film is hardly formed at the interface between the surface layer 13 and the piezoelectric sheet 21. Therefore, it is possible to apply a sufficient electric field to the piezoelectric sheet 21 and the actuator plate 22. The first buffer layer 14 is composed of cheap nickel. Therefore, it is possible to decrease the production cost of the ink-jet head.

EXAMPLES

Next, an explanation will be made below about Examples 1 to 9 in which metal materials for the surface layer 13 and metal materials for the actuator plate 22 are variously changed and combined. As shown in Table 1, stacks are produced with combinations of surface layers 13 and actuator plates 22 in Examples 1 to 9. In this procedure, the stacks are produced in accordance with approximately the same production method as that for the ink-jet head 9 described above.

In Examples 1 to 4, the metal material for constructing the actuator plate 22 is composed of stainless steel, and the thickness thereof is 20 μm. The surface layer 13 of Example 1 is composed only of a nickel layer having a thickness of 5 μm. The surface layer 13 of Example 2 is composed of a nickel layer to serve as the first buffer layer 14 having a thickness of 2 μm, and a gold layer to serve as the second buffer layer 15 having a thickness of 0.2 μm. The surface layer 13 of Example 3 is composed only of a gold layer having a thickness of 0.5 μm. The surface layer of Example 4 is composed of only a gold layer having a thickness of 4 μm.

In Examples 5 to 7, the metal material for constructing the actuator plate 22 is composed of 42 Alloy, and the thickness thereof is 20 μm. The surface layer 13 of Example 5 is composed only of a nickel layer having a thickness of 5 μm. The surface layer 13 of Example 6 is composed of a nickel layer to serve as the first buffer layer 14 having a thickness of 2 μm, and a gold layer to serve as the second buffer layer 15 having a thickness of 0.2 μm. The surface layer 13 of Example 7 is composed only of a gold layer having a thickness of 4 μm.

In Examples 8 and 9, the metal material for constructing the actuator plate 22 is composed of titanium, and the thickness thereof is 20 μm. The surface layer 13 of Example 8 is composed of a nickel layer to serve as the first buffer layer 14 having a thickness of 5 μm, and a gold layer to serve as the second buffer layer 15 having a thickness of 0.2 μm. The surface layer 13 of Example 9 is composed only of a platinum layer having a thickness of 3 μm.

A piezoelectric sheet 21, which is composed of a ceramic material based on the lead titanate zirconate system, is calcinated on the upper surface of the stack formed by combining the actuator plate 22 and the surface layer 13 of each of Examples, i.e., the upper surface of the surface layer 13 to form a stack in which the actuator plate 22 and the piezoelectric sheet 21 are joined to one another with the surface layer 13 intervening therebetween for each of Examples 1 to 9. Table 1 shows the evaluation about the piezoelectric performance and the crystal growth property of the piezoelectric sheet 21 of the stack, the oxidation resistance at the interface between the surface layer 13 and the piezoelectric sheet 21, and the production cost of the head for each of Examples obtained as described above. The crystal growth property was evaluated based on an index determined as follows. That is, the surface of the piezoelectric sheet 21 after the calcination was observed with an electron microscope having a 6,000× magnification to obtain a photograph for each of the combinations of the piezoelectric precursor layer and the base material on which the piezoelectric precursor layer is to be stacked. Twenty crystal grains or particles were randomly selected in the microscopic image of the piezoelectric sheet to measure particle sizes of the grains, and calculate the average value. The obtained average value of particle size was used as the index. Alternatively, crystal growth property was evaluated based on the half band width (peak width at a half height) of X-ray diffraction peak. The oxidation resistance was evaluated by measuring the Tan δ of the piezoelectric sheet 21 for each of Examples and Comparative Examples.

On the other hand, a piezoelectric sheet, which is composed of a ceramic material based on the lead titanate zirconate system, is sintered on each of the actuator plates in which the metal materials for constructing the actuator plates 22 are composed of stainless steel, 42 Alloy, and titanium respectively to form stacks corresponding to Comparative Examples 1 to 3. Table 1 also shows the evaluation about the piezoelectric performance and the crystal growth property of the piezoelectric sheet, the oxidation resistance at the interface between the actuator plate and the piezoelectric sheet, and the production cost of the head for each of the piezoelectric sheets of the stacks of Comparative Examples to 3. The evaluations, which are expressed as "+", "±", and "−" in Table 1, are designated such that "+" is the best evaluation, and "±" is the evaluation somewhat inferior to that of "+". Further, "−" is the worst evaluation, indicating that any problem arises.

TABLE 1

| | | Surface layer | | Crystal growth property and | | |
|---|---|---|---|---|---|---|
| | Actuator plate | First buffer layer | Second buffer layer | piezoelectric performance | Oxidation resistance | Cost of head |
| Example 1 | stainless steel, t = 20 μm | nickel layer, t = 5 μm | — | + | ± | + |
| Example 2 | stainless steel, t = 20 μm | nickel layer, t = 2 μm | gold layer, t = 0.2 μm | + | + | + |
| Example 3 | stainless steel, t = 20 μm | gold layer, t = 0.5 μm | — | ± | + | + |
| Example 4 | stainless steel, t = 20 μm | gold layer, t = 4 μm | — | + | + | − |
| Example 5 | 42 Alloy, t = 20 μm | nickel layer, t = 5 μm | — | + | ± | + |
| Example 6 | 42 Alloy, | nickel layer, | gold layer, | + | + | + |

TABLE 1-continued

| | Actuator plate | Surface layer: First buffer layer | Surface layer: Second buffer layer | Crystal growth property and piezoelectric performance | Oxidation resistance | Cost of head |
|---|---|---|---|---|---|---|
| | t = 20 μm | t = 2 μm | t = 0.2 μm | | | |
| Example 7 | 42 Alloy, t = 20 μm | gold layer, t = 4 μm | — | + | + | − |
| Example 8 | titanium, t = 20 μm | nickel layer, t = 5 μm | gold layer, t = 0.2 μm | + | + | + |
| Example 9 | titanium, t = 20 μm | platinum layer, t = 3 μm | — | + | + | − |
| Comp. Ex. 1 | stainless steel, t = 20 μm | — | — | − | + | + |
| Comp. Ex. 2 | 42 Alloy, t = 20 μm | — | — | − | ± | + |
| Comp. Ex. 3 | titanium, t = 20 μm | — | — | − | ± | + |

As shown in Table 1, both of the crystal growth property and the piezoelectric performance of the piezoelectric sheet are evaluated to be "−" in the case of the piezoelectric sheets of the stacks of Comparative Examples 1 to 3, for the following reason. That is, iron, chromium and the like, which are materials for constructing the actuator plate, are disused into the piezoelectric sheet during the calcination of the piezoelectric sheet, while lead, which constitutes the piezoelectric precursor layer, is diffused into the actuator plate (mutual diffusion). Therefore, the crystal growth is inhibited for the piezoelectric precursor layer to be converted into the piezoelectric sheet. As a result, the piezoelectric performance of the piezoelectric sheet is lowered in Comparative Examples 1 to 3. On the contrary, in the case of the piezoelectric sheets of the stacks of Examples 1 to 9, the surface layers 13, which are composed of the metal materials as shown in Table 1, are formed between the actuator plates 22 and the piezoelectric sheets 21 respectively. Therefore, the component for constructing the actuator plate 22 and the component for constructing the piezoelectric precursor layer to be converted into the piezoelectric sheet 21 as described above are not subjected to the mutual diffusion during the calcination of the piezoelectric sheet 21 to such an extent that the crystal growth of the piezoelectric precursor layer is inhibited. Therefore, the piezoelectric performance of the piezoelectric sheet 21 is not lowered, and hence the evaluation is "+" for almost all of them as shown in Table 1. Thus, the satisfactory results are obtained. The evaluation is "±" for the crystal growth and the piezoelectric performance of the piezoelectric sheet 21 in the case of only Example 3, for the following reason. That is, the thickness of the surface layer 13 composed of the gold layer is extremely thin, i.e., 0.5 μm. Therefore, there is such a possibility that the material for constructing the actuator plate 22 may be incorporated into the piezoelectric sheet 21 during the calcination of the piezoelectric sheet 21 in rare cases. However, the gold layer is formed as the surface layer 13 even when the layer is thin. Therefore, even when the material for constructing the actuator plate 22 is incorporated into the piezoelectric sheet 21 during the calcination of the piezoelectric sheet 21, the amount thereof is extremely minute. Therefore, the crystal growth of the piezoelectric sheet 21 is scarcely inhibited. For this reason, the piezoelectric performance of the piezoelectric sheet 21 is lowered extremely slightly. Therefore, the evaluation of "±" is given in Example 3.

In all of Comparative Examples 1 to 3, the production cost of the head are evaluated to be "+". However, the oxidation resistance is evaluated to be "±" in Comparative Examples 2 and 3, for the following reason. That is, 42 Alloy and titanium, which constitute the actuator plates of Comparative Examples 2 and 3, respectively, are slightly inferior in the oxidation resistance to stainless steel for constructing the actuator plate of Comparative Example 1. On the contrary, the evaluation of the oxidation resistance is "+" for Examples 2 to 4 and Example 6 to 9 in which the layer, which forms the interface with respect to the piezoelectric sheet 21, is gold or platinum layer, for the following reason. That is, gold and platinum are excellent in the oxidation resistance than stainless steel. In Examples 1 and 5, the layer, which forms the interface with respect to the piezoelectric sheet 21, is the nickel layer, and hence the evaluation of the oxidation resistance is "±", for the following reason. That is, nickel is slightly inferior in the oxidation resistance to stainless steel, gold, and platinum. However, even when the layer, which forms the interface with respect to the piezoelectric sheet 21, is the nickel layer, nickel can be used as the surface layer 13 without any problem, because the oxide film is hardly formed at the interface with respect to the piezoelectric sheet 21.

In Examples 1 to 3, Example 5, and Examples 6 and 8, the gold or platinum layer is not formed, or the thickness is extremely thin even when the gold or platinum layer is formed. Therefore, the production cost of the head is cheap, and the evaluation is "+". However, in Examples 4, 7, and 9, the thickness of the gold or platinum layer is large. Therefore, the price of the material for the gold or platinum layer is expensive, and the evaluation is "−" in view of the production cost of the head. The production cost of the head is of course cheap in Comparative Examples 1 to 3, because the surface layer is not formed. In Examples 1 and 5, the surface layer 13 is formed only of the nickel layer, and nickel is extremely cheap. Therefore, the production cost of the head is the lowest in Examples 1 and 5 among Examples 1 to 9.

As described above, according to Examples 1 to 9, the crystal growth is advanced satisfactorily during the calcination of the piezoelectric precursor layer to be converted into the piezoelectric sheet 21, as compared with Comparative Examples 1 to 3. Therefore, the piezoelectric performance of the piezoelectric sheet 21 is scarcely deteriorated. In other words, if the piezoelectric sheet is formed on the actuator plate in the state in which no surface layer is formed as in Comparative Examples 1 to 3, then the metal material for constructing the actuator plate is incorporated therein during the calcination of the piezoelectric precursor layer to be converted into the piezoelectric sheet, and the crystal growth of the piezoelectric precursor is inhibited. However, in the embodiments of the present invention, the various surface layers 13 are formed between the actuator plate 22 and the piezoelectric sheet 21. Therefore, the crystal growth, which is effected during the calcination of the piezoelectric precursor layer, is scarcely inhibited by the metal material for constructing the actuator plate 22. Therefore, the piezoelectric performance of the piezoelectric sheet 21 is scarcely deteriorated. According to the above, it is appreciated that the deterioration of the piezoelectric performance of the piezoelectric sheet 21 is suppressed by forming, between the actuator plate 22 and the piezoelectric sheet 21, the surface layer composed of the metal material which hardly causes the harmful influence that would be otherwise caused by the mutual diffusion.

Next, Table 2 shows the influence exerted on the crystal growth property of the piezoelectric precursor layer by the difference in the quality of the base material (buffer layer intervening between the piezoelectric sheet and the actuator plate) for stacking the piezoelectric precursor layer, with average values of particle size of the actuator sheet. The base materials, on which the piezoelectric precursor layer is to be stacked, are a nickel foil to be used in Example 10 and a gold foil to be used in Example 11. On the other hand, stainless steel, which has the same quality as that of the actuator plate, is used in Comparative Example 4. A piezoelectric precursor layer, which is based on a raw material of PZT-based piezoelectric particles having an average particle size of 0.3 μm, was manufactured on each of the base materials. After that, the piezoelectric precursor layer and each of the base materials were heated at 850° C. for 15 minutes in an electric furnace, and thus the piezoelectric precursor layer was subjected to the crystal growth. The average particle size of the piezoelectric sheet was measured for each of Examples 10, 11 and Comparative Examples 4 in the same manner as explained above.

TABLE 2

| | Base material | Average particle size of piezoelectric sheet |
|---|---|---|
| Ex. 10 | nickel foil | 1.0 μm |
| Ex. 11 | gold foil | 1.3 μm |
| Comp. Ex. 4 | stainless steel | 0.5 μm |

According to Table 2, the growth is achieved in Example 10 such that the average particle size of the piezoelectric precursor layer converted into the piezoelectric sheet after the calcination arrives at the particle size of 1 μm. In Example 11, the gold foil, which scarcely causes the mutual diffusion and which has the high thermal stability, is used. Therefore, the piezoelectric precursor layer, which is converted into the piezoelectric sheet after the calcination, has the average particle size of 1.3 μm. In this result, the crystal growth of the piezoelectric precursor layer is advanced as compared with Example 10. On the other hand, in Comparative Example 4, the piezoelectric sheet, which is converted into the piezoelectric sheet after the calcination, has the average particle size of 0.5 μm. Considering the fact that the average particle size of the piezoelectric precursor layer before the calcination is 0.3 μm, the crystal growth of the piezoelectric precursor layer converted into the piezoelectric sheet after the calcination is scarcely advanced in this result. Accordingly, it is appreciated that the calcinated piezoelectric precursor layer is subjected to the crystal growth satisfactorily while the crystal growth is not inhibited by the base material, when the base material is the nickel foil as in Example 10 or when the base material is the gold foil as in Example 11.

Preferred embodiments of the present invention have been explained above. However, the present invention is not limited to the embodiments described above, which can be variously changed and designed within a scope defined in claims. For example, magnesium, zinc, and niobium may be used as metal materials other than nickel, in which the effect as the first buffer layer as explained above can be realized. In this case, those preferably usable as the method for forming the first buffer layer include the vapor growth method such as the sputtering method and the vapor deposition method. In the case of the ink-jet head 9 described above, the second buffer layer 15 is formed on the first buffer layer 14. However, in view of the suppression of the mutual diffusion between the actuator plate 22 and the piezoelectric sheet 21, the second buffer layer 15 may not be provided when the first buffer layer 14 is composed of the metal material such as gold and platinum, for the following reason. That is, gold and platinum have the excellent thermal stability and the excellent oxidation resistance. Therefore, it is possible to suppress the mutual diffusion between the actuator plate 22 and the piezoelectric sheet 21 and the formation of the oxide film to be formed at the interface with respect to the piezoelectric sheet 21 in the same manner as in the embodiments described above. Further, the surface layer may be constructed only by the first buffer layer composed of nickel. Accordingly, it is possible to suppress the mutual diffusion between the actuator plate 22 and the piezoelectric sheet 21, although the oxidation resistance is inferior.

The second buffer layer 15 may be composed of a metal material other than gold and platinum. The actuator plate may be constructed by any metal material other than stainless steel, 42 Alloy, and titanium provided that the metal material for constructing the actuator plate does not cause the decrease in the strength even when the metal material is heated at not less than the predetermined temperature.

The method for producing the ink-jet head 9 as described above may not include the step of forming the second buffer layer 15 provided that the layer (first buffer layer), which serves as the surface layer, is formed between the actuator plate 22 and the piezoelectric sheet 21.

In the embodiments described above, the piezoelectric sheet (piezoelectric member) is formed to range over all of the pressure chambers. However, independent piezoelectric members corresponding to the respective pressure chambers may be formed. In the embodiments described above, the plates except for the nozzle plate are integrated into one unit by the joining while effecting the diffusion, and then the first and second buffer layers are formed on the actuator plate. However, an actuator plate, on which the buffer layers are previously provided, may be used to form the flow passage unit by the joining while effecting the diffusion thereafter. The piezoelectric sheet is manufactured after forming the flow passage unit by the joining while effecting the diffusion of the plates except of the nozzle plate. However, the following procedure may also be available. That is, the piezoelectric sheet is formed for a stack in a state in which only the actuator plate is provided or the actuator plate and the cavity plate are joined to each other. Further, the remaining plates are stuck thereto with an adhesive to manufacture the flow passage unit.

What is claimed is:

1. A method for producing an ink-jet head, comprising the steps of:

manufacturing a flow passage unit including a vibration plate which is made of metal, an ink chamber which is closed by the vibration plate, and a nozzle which is communicated with the ink chamber and which discharges an ink;

forming a first buffer layer on the vibration plate;

forming, a second buffer layer on the first buffer layer;

forming a piezoelectric precursor on the second buffer layer; and heating the flow passage unit, the first buffer layer, the second buffer layer, and the piezoelectric precursor so that the piezoelectric precursor is calcinated into a piezoelectric member, wherein:

the first buffer layer is formed of a metal material with which mutual diffusion between the first buffer layer and the piezoelectric precursor during the heating is less than mutual diffusion between the piezoelectric precursor and the vibration plate when the heating is performed without the first buffer layer, and the second buffer layer is formed of a metal material with which mutual diffusion between the second buffer layer and the piezoelectric precursor during the heating is less than the mutual diffusion between the vibration plate and the piezoelectric precursor when the heating is performed without the second buffer layer.

2. The method for producing the ink-jet head according to claim 1, wherein the second buffer layer has oxidation resistance which is equivalent to or greater than that of the vibration plate.

3. The method for producing the ink-jet head according to claim 2, wherein the second buffer layer is formed of gold.

4. The method for producing the ink-jet head according to claim 1, wherein the vibration plate is formed of one material selected from the group consisting of stainless steel, titanium, and 42 Alloy, and the heating is performed in the heating step at a temperature of 600° C. to 900° C.

5. The method for producing the ink-jet head according to claim 1, wherein the first buffer layer is formed of one material selected from the group consisting of nickel, platinum, and gold.

6. The method for producing the ink-jet head according to claim 1, wherein the first buffer layer is formed of nickel.

7. The method for producing the ink-jet head according to claim 1, wherein the first buffer layer has a thickness of not less than 2 μm.

8. A method for producing an ink-jet head, comprising the steps of:

manufacturing a flow passage unit including a vibration plate which is made of metal, an ink chamber which is closed by the vibration plate, and a nozzle which is communicated with the ink chamber and which discharges an ink;

forming a nickel layer on the vibration plate;

forming a gold layer on the nickel layer;

forming a piezoelectric precursor on the gold layer; and heating the flow passage unit, the nickel layer, the gold layer, and the piezoelectric precursor at a temperature of 600° C. to 900° C. so that the piezoelectric precursor is calcinated into a piezoelectric member.

9. The method for producing the ink-jet head according to claim 8, wherein the vibration plate is formed of one material selected from the group consisting of stainless steel, titanium, and 42 Alloy.

10. A method for producing an ink-jet head, comprising the steps of:

manufacturing a flow passage unit including a vibration plate which is made of metal, an ink chamber which is closed by the vibration plate, and a nozzle which is communicated with the ink chamber and which discharges an ink;

forming a first buffer layer on the vibration plate;

forming a piezoelectric precursor on the first buffer layer; and heating the flow passage unit, the first buffer layer, and the piezoelectric precursor so that the piezoelectric precursor is calcinated into a piezoelectric member, wherein:

the first buffer layer is formed of a metal material with which mutual diffusion between the first buffer layer and the piezoelectric precursor during the heating is less than mutual diffusion between the piezoelectric precursor and the vibration plate when the heating is performed without the first buffer layer, and the vibration plate is formed of one material selected from the group consisting of stainless steel, titanium, and 42 Alloy, and the heating is performed in the heating step at a temperature of 600° C. to 900° C.

11. The method for producing the ink-jet head according to claim 10, further comprising, before the heating step and the forming a piezoelectric precursor step, a step of forming, on the first buffer layer, a second buffer layer formed of a metal material with which mutual diffusion between the second buffer layer and the piezoelectric precursor during the heating is less than the mutual diffusion between the vibration plate and the piezoelectric precursor when the heating is performed without the second buffer layer, wherein the second buffer layer has oxidation resistance which is equivalent to or greater than that of the vibration plate.

12. The method for producing the ink-jet head according to claim 11, wherein the second buffer layer is formed of gold.

13. The method for producing the ink-jet head according to claim 10, wherein the first buffer layer is formed of one material selected from the group consisting of nickel, platinum, and gold.

14. The method for producing the ink-jet head according to claim 10, wherein the first buffer layer is formed of nickel.

15. The method for producing the ink-jet head according to claim 10, wherein the first buffer layer has a thickness of not less than 2 μm.

* * * * *